United States Patent [19]

Kipross

[11] Patent Number: 4,860,517

[45] Date of Patent: Aug. 29, 1989

[54] FRAMEWORK STRUCTURE FOR WINDOWS AND DOORS

[75] Inventor: Stanley Kipross, Durban, South Africa

[73] Assignee: Hulett Aluminium Limited, Pietermaritzburg, South Africa

[21] Appl. No.: 186,600

[22] Filed: Apr. 27, 1988

[30] Foreign Application Priority Data

Jul. 24, 1987 [ZA] South Africa ..... 87/5465

[51] Int. Cl.[4] ..... E06B 3/68

[52] U.S. Cl. ..... 52/656; 52/456; 52/664; 52/397

[58] Field of Search ..... 52/455, 456, 397, 664, 52/666, 656

[56] References Cited

U.S. PATENT DOCUMENTS

| | | | |
|---|---|---|---|
| 1,093,587 | 4/1914 | McClure | 52/456 |
| 1,101,745 | 6/1914 | Jones | 52/456 |
| 2,260,657 | 10/1941 | Bohnsack | 52/455 |
| 3,108,336 | 10/1963 | Tate | 52/456 |
| 3,284,976 | 11/1966 | Kadish | 52/455 |
| 4,702,055 | 10/1987 | Ralph | 52/664 |

*Primary Examiner*—John E. Murtogh

*Attorney, Agent, or Firm*—St. Onge Steward Johnston & Reens

[57] ABSTRACT

The invention relates to a framework structure for a "cottage pane" style door or window. The framework structure includes a series of tubular framework elements defining formations whereby these elements are frictionally held together in their operative configuration. When so held, tie rods can pass through the auxiliary elements and apertures in the primary elements for bracing the complete structure into a unit.

25 Claims, 5 Drawing Sheets

FRAMEWORK STRUCTURE FOR WINDOWS AND DOORS

This invention relates to a framework structure for a window, a door, or the like.

Framework structures of various shapes and configurations, and which are used for windows and doors, are known to the Applicants. The present invention relates particularly to framework structures having a style known as the "cottage pane" style, in which a plurality of cross-members form a lattice defining a multi-division support structure for a plurality of separate glass panes. Such frameworks are generally of timber and comprise a plurality of elongate timber elements secured together by nails, dowels, wood glue, or the like, to form a planar structure into which the individual glass panes can be securely received.

It is also known to the Applicant to provide framework structures, of the above type, of metal materials, such as aluminium, but the construction of these structures have not proved entirely satisfactory insofar as it has always been difficult to hold the framework elements of these structures in their desired configuration and also to secure these elements to one another in this configuration.

It is accordingly an object of this invention to provide a framework structure for a window, a door, or the like, having a style known as the "cottage pane" style and which is made up of metal framework elements that can be easily held in their required configuration with respect to one another for permitting them to be secured together, in a convenient manner, while being held in this required configuration.

According to the invention there is provided a rectangular framework structure for a door or window, which includes

- four primary framework elements forming the outer perimeter of the rectangular framework structure;
- a plurality of secondary framework elements extending between two opposing primary framework elements;
- a plurality of auxiliary framework elements extending perpendicularly between the secondary elements and parallel adjacent primary elements, spacing apart these elements; and
- a plurality of tie-rods holding together the framework elements, bracing them into a rigid substantially planar structure, the framework elements all defining an operative front wall, a rear wall, at least one side wall extending between the front wall and the rear wall and an elongate angularly disposed locating flange extending operatively rearwardly from a location near the front wall on the sides of the framework elements that oppose other framework elements in their operative configuration, the angular locating flanges of the primary and secondary elements being cut away to receive and frictionally locate the auxiliary elements in their required configuration.

According to a preferred embodiment of the invention, the primary framework elements may define only one side wall on the side of these elements that face the secondary and auxiliary framework elements, whereas the secondary and auxiliary framework elements may define two spaced apart side walls, which, together with the front wall and rear wall form tubular elements having a substantially rectangular cross-sectional profile.

For the above configuration of the auxiliary framework elements, the tie-rods may pass centrally through the auxiliary framework elements and through apertures provided in the side walls of the primary and secondary elements. Also, the opposite ends of the tie-rods may be threaded and may be engageable by means of nuts, so that complete framework structures can be tightened together thereby.

The angle between the locating flanges and the plane defined by the side walls of the framework elements may be between 30° and 60° and, typically, the said angle may be approximately 45°.

Furthermore, the locating flanges of the primary and secondary framework elements may be cut away so that opposing ends of the auxiliary framework elements can fit snugly into the cut away formations and frictionally engage the primary and/or secondary framework elements.

Further according to the invention, some of the framework elements may have glass pane locating flanges removably engaged therewith and projecting from the sides thereof, while other framework elements may have glass pane locating flanges fixedly extending from the sides thereof, the glass pane locating flanges opposing the angularly disposed locating flanges to effectively define channel formations within which glass panes can be received and located. According to a preferred embodiment of the invention, the secondary framework elements and primary framework elements, disposed parallel therewith, may have glass pane locating flanges fixedly extending therefrom, whereas the auxiliary framework elements and primary framework elements, disposed parallel therewith, have glass pane locating flanges removably engaged therewith.

The glass pane locating flanges of the auxiliary framework elements and said primary framework elements may be separate flange elements that can removably engage engagement formations defined by the said auxiliary framework elements and primary framework elements. More specifically, the glass pane locating flange elements and auxiliary framework elements and primary framework elements may define complementary engagement formations whereby they can removably engage one another.

Still further according to the invention, the angular locating flanges and glass pane locating flanges may define suitable formations along the length thereof for receiving sealing elements that can provide for the sealing location of glass panes within the framework structure. More particularly, the configuration of the framework structure may be such that a hollow space is defined operatively beneath the angular locating flanges within which sealing elements are receivable, whereas the free ends of the glass pane locating flanges may define a lip formation projecting towards the angular locating flanges and which can provide for the location of sealing elements with respect to these glass pane locating flanges. Alternatively, the free ends of the glass pane locating flanges may define serrations projecting towards the angular locating flanges and which can provide for the location of sealing elements with respect to these glass pane locating flanges.

The framework structure of the invention may accordingly include sealing elements that can provide for the sealing location of glass panes within the framework structure. The sealing elements may be particularly adapted to co-operate with the angular locating flanges and the glass pane locating flanges, respectively.

Still further according to his invention, the primary framework elements of a framework structure, in accordance with the invention, may be secured to one another by means of securing means such as screws, rivets, bolts and nuts, or the like. Also, the overall configuration of the framework elements may be such that consistent front and rear faces are defined by the assembled framework structure.

The framework elements may be of any suitable material and, preferably, may be of aluminium. As such, they may be of anodized aluminium giving a timber appearance.

The framework structure may still further include glass panes located in the spaces defined between the framework elements.

It is anticipated that the rectangular framework structure of the invention can be provided in kit form and the invention accordingly extends to a kit for a framework structure which includes the framework elements and tie-rods for a framework structure, in accordance with the present invention. The said kit may further include glass panes for fitting into a framework structure made up of the above framework elements.

Still further, the invention extends to a method of manufacturing a framework structure for a door or window, which includes, arranging and frictionally locating a plurality of suitable elongate framework elements into a configuration in which they form a lattice defining a multi-divison structure for sheet-like glass panes, and bracing the elements into a rigid structure by means of tie-rods.

This method may particularly include the use of framework elements for a framework structure, in accordance with the invention. Still further, the method may include locating glass panes into the framework structure formed.

The invention clearly extends also to a framework structure manufactured in accordance with the method of the invention, as well as to framework elements for a framework structure, in accordance with the invention.

The invention is now decribed, by way of an example, with reference to the accompanying diagrammatic drawings, in which;

FIG. 2 (B) shows a detailed plan view of a part of the framework structure of FIG. 1;

Figure 1:
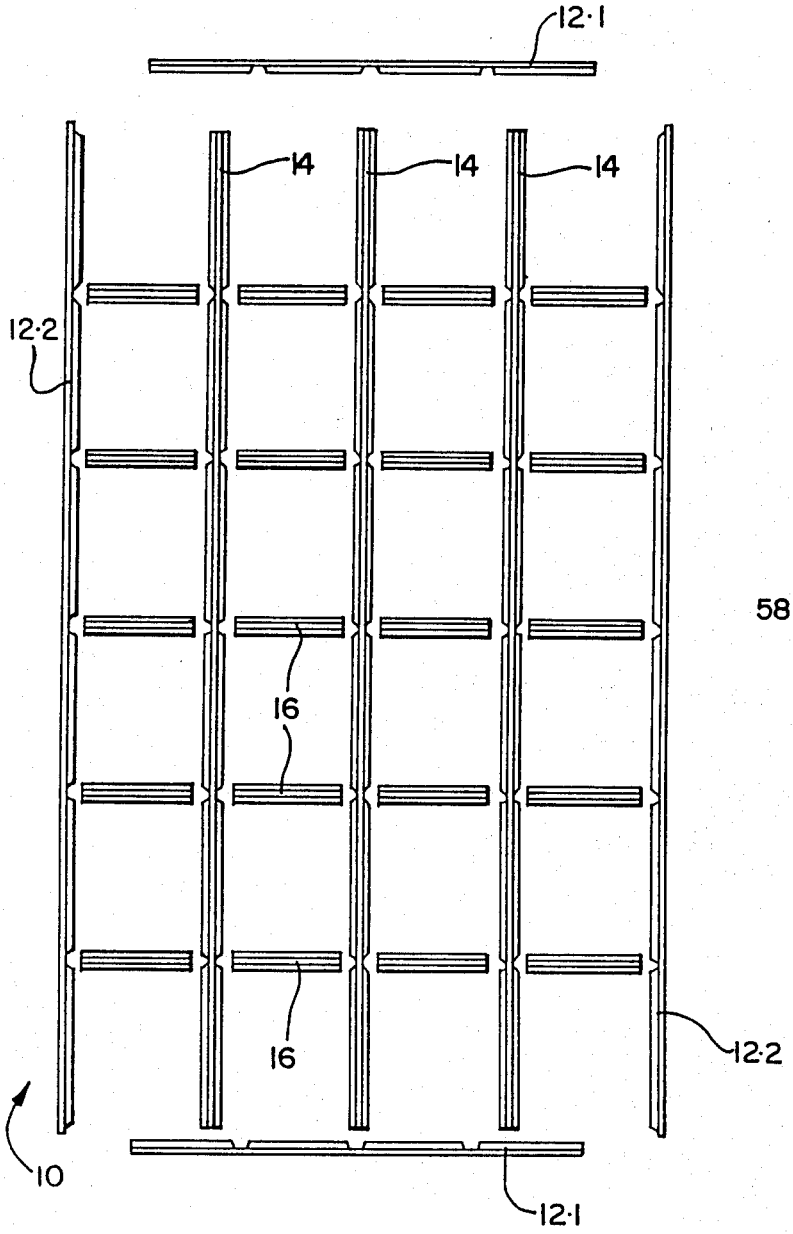
FIG. 1 shows an exploded front view of a rectangular framework structure for a door, in accordance with the invention.

Referring to the drawings, a framework structure for a door, in accordance with the invention, is generally indicated by the reference numeral 10. The structure 10 generally includes four primary framework elements 12 that form the outer perimeter of the rectangular framework structure 10, three secondary framework elements 14 that extend between the primary framework elements 12.1 and being disposed parallel to the primary framework elements 12.2 and five sets of auxiliary framework elements 16, that extend perpendicularly between the secondary and their parallel adjacent primary framework elements, spacing apart these elements.

Figure 6:
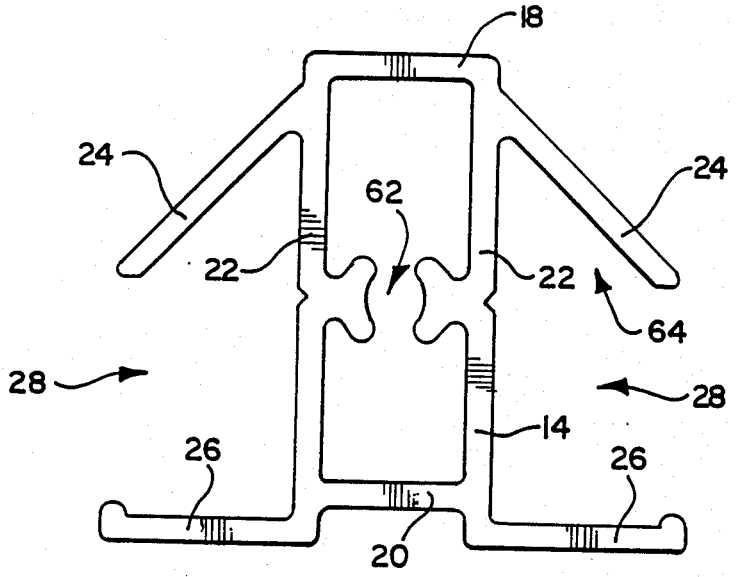
FIG. 6 shows an end view of a secondary framework element for the framework structure of FIG. 1.

The secondary elements 14 have a generally rectangular tubular profile defined by a front wall 18, a rear wall 20 and two opposing side walls 22 (see FIG. 6). Two elongate angularly disposed locating flanges 24 project from the side walls 22, at an angle of approximately 45° thereto, the flanges 24 projecting from the side walls 22 at a set-back location from the front wall 18. The secondary elements 14 further include two elongate glass pane locating flanges 26, also projecting from the side walls 22, parallel to the rear wall 20 and operatively set-back with respect to this rear wall 20. Elongate channel formations 28 are therefore defined between the flanges 24 and 26, within which glass panes can be located in the manner hereinafter described.

Figure 7:
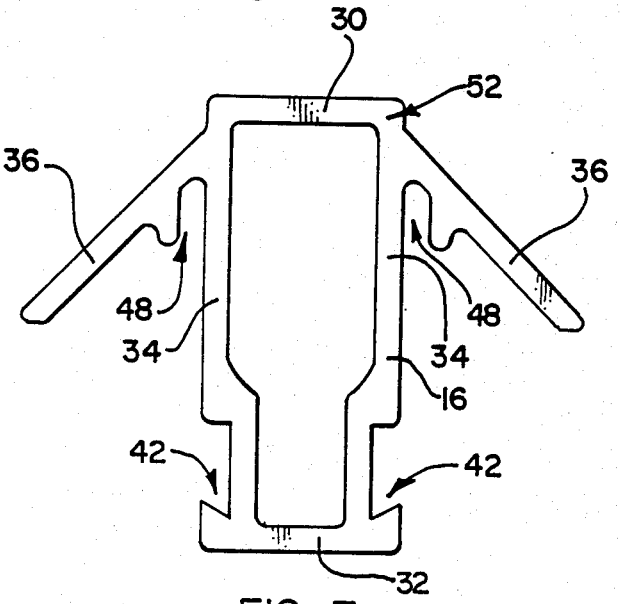
FIG. 7 shows an end view of an auxiliary framework element for the framework structure of FIG. 1.
Figure 8:
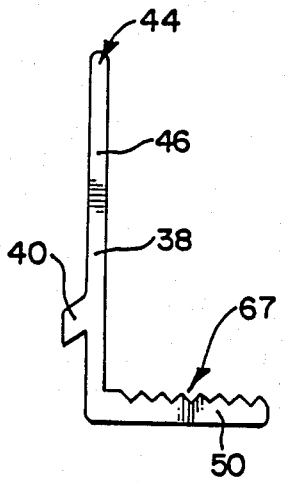
FIG. 8 shows an end view of a glass pane locating flange for the framework structure of FIG. 1.

The auxiliary framework elements 16 are of an equivalent configuration to the secondary elements 14 except insofar as these elements do not have fixed glass pane locating flanges projecting therefrom, but make provision for separate flange elements to be removably engaged therewith. As such, the framework elements 16 again have a generally rectangular tubular cross-sectional profile being defined by a front wall 30, a rear wall 32 and two opposing side walls 34 (see FIG. 7). Each element 16 further has two angularly disposed locating flanges 36 extending along the length thereof, the flanges 36 being similarly disposed to the side walls 34 of the element 16 as are the flanges 24 of the secondary elements 14. A typical glass pane locating flange element is illustrated in FIG. 8 and is generally indicated by the reference numeral 38. This flange element is generally L-shaped and has a projecting engagement formation 40 projecting therefrom as shown, the formation 40 being adapted to engage a complementary formation 42 defined within the side walls 34 of the element 16, with the free end 44 of the leg 46 of the element 38 being located within a receiving formation 48 defined between the side walls 34 and flanges 36 of the element 16.

Clearly, flange elements 38 can be located on opposite sides of the auxiliary elements 16 and, when so engaged, the auxiliary framework elements 16 become essentially the equivalent of the secondary elements 14 insofar as they will define channel formations along their length between the flanges 36 and the bar 50 of the flange elements 38, that will oppose the flanges 36.

The cross-sectional profile of the primary elements 12.1 is essentially the equivalent of the cross-sectional profile of the auxiliary elements 16, except insofar as these elements only have one side wall, so that an open, operatively outwardly projecting channel formation is defined between this side wall and the operative front wall and rear wall projecting therefrom.

Similarly, the cross-sectional profile of the primary elements 12.2 is essentially the equivalent of the cross-sectional profile of the secondary elements 14 except insofar as these elements again only define one side wall so that an open outwardly projecting, channel formation between the front wall and rear wall and the said side wall is defined.

Figure 9:
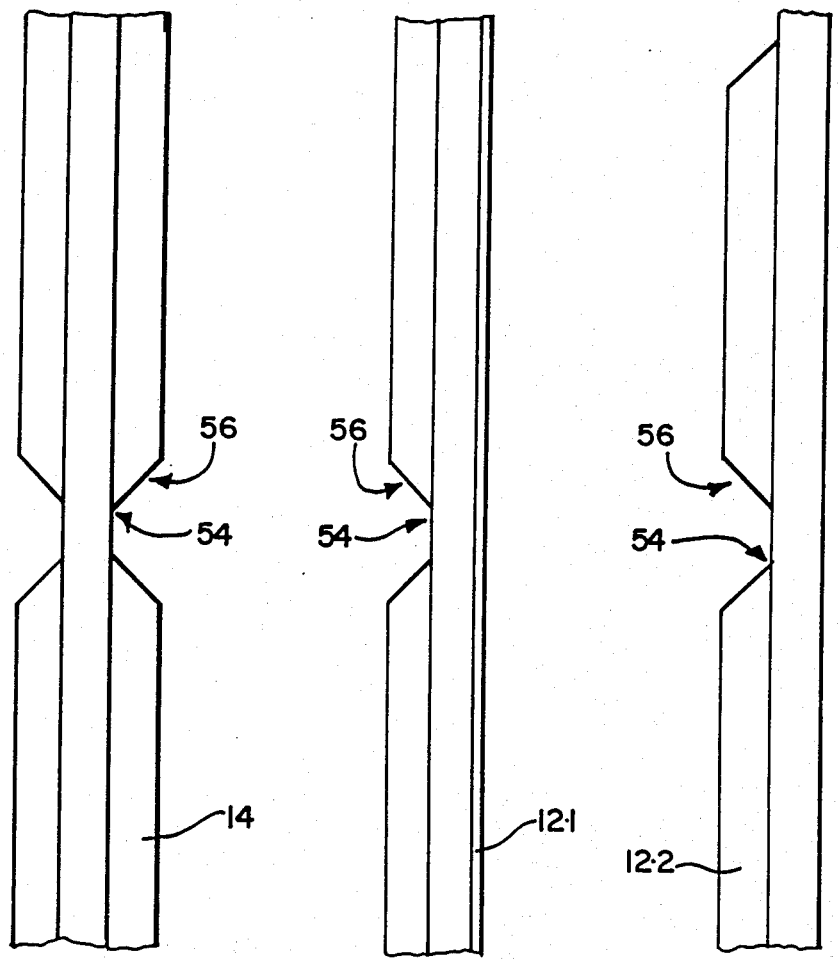
FIG. 9 shows in plan view three framework elements used for the framework structure of FIG. 1, illustrating cut-aways therein for the location of the auxiliary framework elements.

In order to provide for the location of the auxiliary elements 16 between the primary elements 12.2 and secondary elements 14, the opposing flanges 24 of the said elements 12.2 and 14 are cut away as illustrated in FIG. 9, the profile of the cut-away portions being such that the opposite ends of the auxiliary elements 16 will fit snugly into these cut-away portions with the head section 52 of the elements 16 fitting frictionally between the narrowest region 54 of the cut-away portions 56. As such the elements 12.2 and 14 are frictionally engaged and provision is made for the proper location of the elements with respect to one another.

Figure 3:
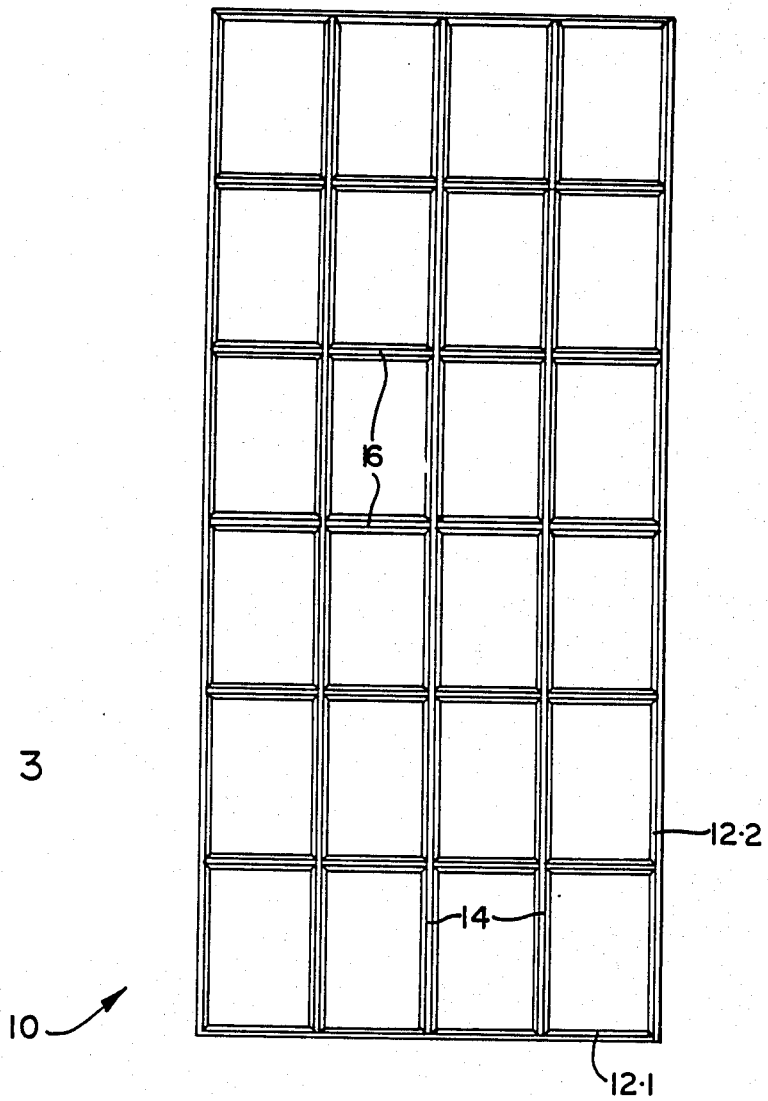
FIG. 3 shows a front view of the assembled framework structure of FIG. 1.
Figure 4:
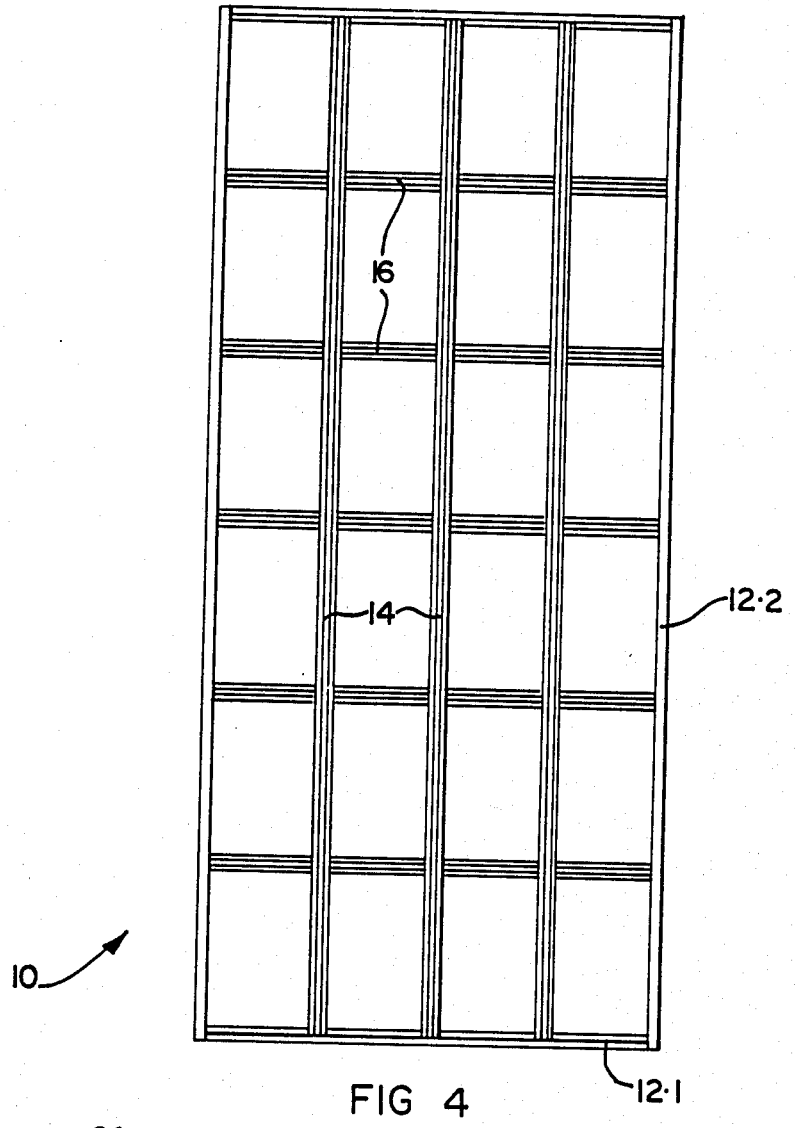
FIG. 4 shows a rear view of the assembled framework structure of FIG. 1.

The flanges of the primary elements 12.1 are similarly cut away to receive and locate the free ends of the secondary elements 14. As such, provision is made for all the framework elements 12, 14 and 16 to be accurately located with respect to one another in their configuration as is clearly illustrated in FIGS. 3 and 4.

The complete framework structure 10 is braced together into a secure rigid structure by means of tie-rods 58 that pass centrally through the auxiliary elements 16 and through apertures (not shown) provided therefor in the side walls 22 of the primary framework elements 12.2 and secondary elements 14.

Figure 2A:
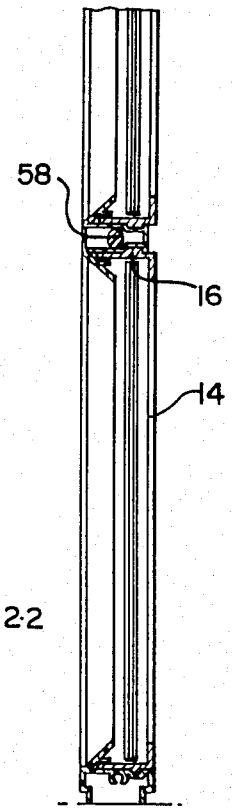
FIG. 2 (A) shows a detailed cross-sectional side view of a part of the framework structure of FIG. 1
Figure 2B:
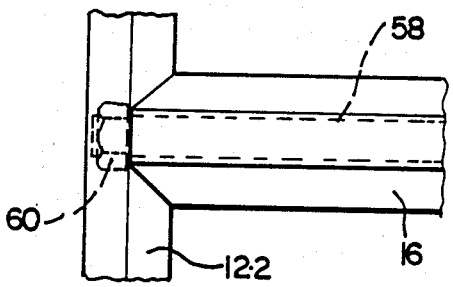

The opposite ends of the tie-rods 58 are threaded so that nuts 60 can be tightened onto these ends to thereby brace together all the framework elements of the structure 10 (see FIGS. 2(A) and 2(B).

Figure 10:
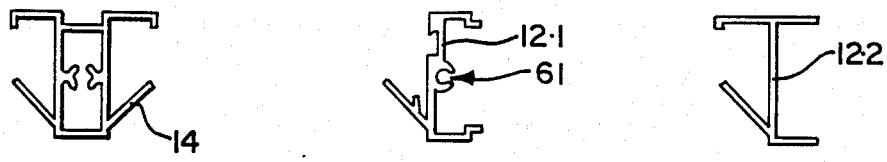
FIG. 10 shows an end view of the three framework elements of FIG. 9.

The primary framework elements 12.1 and 12.2 are secured together by means of screws (not shown), the screws passing through apertures provided therefor near the ends of the framework elements 12.2 and screwing into receiving formations 61 defined therefore by the primary elements 12.1 (see FIG. 10 also). Screws also pass through the side walls of the primary elements 12.1, engaging receiving formations 62 defined by the secondary elements 14, thereby providing for a completely rigid structure.

Figure 5:
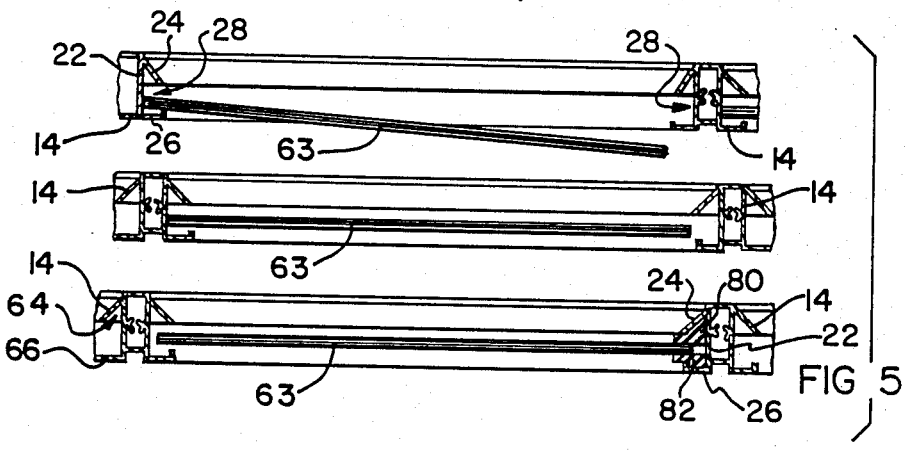
FIG. 5 illustrates in three steps the method of inserting a glass pane into the framework structure of FIG. 1.

It is also anticipated by the Applicant that the complete structure 10 can be provided with glass panes located within the rectangular spaces defined between all the framework elements and it is particularly anticipated that these glass panes are located in position via the rear side of the structure 10 in the manner hereinafter described. Referring also to FIG. 5 of the drawings, a glass pane 63 is shown therein, the first step of its location being to insert one side of the glass pane 63 into the channel formation 28 defined by a framework element 14, the overall width of the glass pane 63 being such that when this side edge is fully inserted into the channel formation 28, the opposite side edge thereof can be displaced into alignment with the opposite channel formation of the opposite framework element 14. The glass pane is then partially displaced towards the said opposite framework element whereafter a first glass pane locating flange element 38 can be located in position with respect to the auxiliary framework element 16 disposed beneath the glass pane 63 (not shown). The overall height of the glass pane 63 is particularly such that it fits exactly between the opposing side walls of opposite auxiliary framework elements 16, the final step for locating the glass pane 63 therefore comprising the location of a second flange element 38 with respect to the auxiliary framework element 16 disposed above the upper edge of the glass pane 63 (not shown).

Clearly, suitable sealing elements may be located between the glass pane 63 and the walls of the respective flanges 24, 26, 36 and 50, pre-manufactured sealing elements conventiently being provided for this purpose. More particularly, the triangular space 64 defined between the flanges 24 and side walls 22 of the elements 14 serve as a receiving formations for sealing elements 80, on one side of glass panes 63 whereas the elongate lip formations 66 provide for the proper location of sealing elements 82 between the flanges 26 of the elements 14 and the glass panes 63 (only one sealing element of each type 80, 82 being shown in FIG. 5). The serrations 67 defined by the flange elements 38 serve a similar purpose and provide for the secure location of similar sealing elements between these flange elements and glass panes 63.

It will accordingly be appreciated that a completely rigid and water tight structure can be provided which can conveniently serve as a door that simulates the well known "Cottage Pane" style. Clearly, similar structures can be provided for alternative configuration doors, windows, or the like.

The invention extends also to the method of forming a framework structure including the steps as are hereinabove described. Furthermore, the invention extends to a kit including the necessary framework elements, tie-rods, glass panes, and the like, for forming a framework structure 10 as is hereinabove described, or an equivalent structure.

The framework elements forming the structure 10 as above described is preferably of aluminium and may be anodized or otherwise coloured to give them a timber appearance.

I claim:

1. A rectangular framework structure for a door or window, comprising:

four primary framework elements forming the outer perimeter of the rectangular framework structure;

a plurality of secondary framework elements extending between two opposing primary framework elements;

a plurality of auxiliary framework elements located perpendicularly between the secondary elements and parallel adjacent primary elements, spacing apart these elements; and a plurality of tie-rods holding together the framework elements, bracing them into a rigid substantially planar structure, the framework elements all defining an operative front wall, a rear wall, at least one side wall extending between the front wall and the rear wall and an elongate angularly disposed locating flange extending operatively rearwardly from a location near the front wall on the sides of the framework elements that oppose other framework elements in their operative configuration, the angle of the angular locating flange to the plane of adjacent sidewalls of the framework elements being between about 30° to about 60° and the angular locating flanges of the primary and secondary elements being cut away to receive and frictionally locate the auxiliary elements in their required configuration.

2. A framework structure as claimed in claim 1, in which the primary framework elements define only one side wall on the side of these elements that face the secondary and auxiliary framework elements.

3. A framework structure as claimed in claim 1, in which the secondary and auxiliary framework elements define two spaced apart side walls which, together with the front wall and rear wall form tubular elements having a substantially rectangular cross-sectional profile.

4. A framework structure as claimed in claim 1, in which the tie-rods pass centrally through the auxiliary framework elements and through apertures provided in the side walls of the primary and secondary elements.

5. A framework structure as claimed in claim 4, in which the opposite ends of the tie-rods are threaded and are engageable by means of nuts, so that complete framework structures can be tightened together thereby.

6. A framework structure as claimed in claim 1, in which the said angle is approximately 45°.

7. A framework structure as claimed in claim 1, in which the locating flanges of the primary and secondary framework elements are cut away so that opposing ends of the auxiliary framework elements can fit snugly into the cut-away formations and frictionally engage the primary and/or secondary framework elements.

8. A framework structure as claimed in claim 1, in which some of the framework elements have glass plane locating flanges removably engaged therewith and extending from the sides thereof and other framework elements have glass pane locating flanges fixedly extending from the sides thereof, the glass pane locating flanges opposing the angularly disposed locating flanges to effectively define channel formations within which glass panes can be received and located.

9. A framework structure as claimed in claim 8, in which the secondary framework elements and primary framework elements, disposed parallel therewith, have glass pane locating flanges fixedly extending therefrom, whereas the auxiliary framework elements and primary framework elements, disposed parallel therewith, have glass pane locating flanges removably engaged therewith.

10. A framework structure as claimed in claim 9, in which the glass pane locating flanges of the auxiliary framework elements and said primary framework elements are separate flange elements that can removably engage engagement formations defined by the said auxiliary framework elements and primary framework elements.

11. A framework structure as claimed in claim 10, in which the glass pane locating flange elements and auxiliary framework elements and primary framework elements define complementary engagement formations whereby they can removably engage one another.

12. A framework structure as claimed in claim 8, in which the angular locating flanges and glass pane locating flanges define suitable formations along the length thereof for receiving sealing elements that can provide for the sealing location of glass panes within the framework structure.

13. Framework structure as claimed in claim 12, in which a hollow space is defined operatively beneath the angular locating flanges within which sealing elements are receivable and in which the free ends of the pane locating flanges define a lip formation projecting towards the angular locating flanges and which can provide for the location of sealing elements with respect to these pane locating flanges.

14. A framework structure as claimed in claim 12, in which a hollow space is defined operatively beneath the angular locating flanges within which sealing elements are receivable and in which the free ends of the pane locating flanges define serrations projecting towards the angular locating flanges and which can provide for the location of sealing elements with respect to these pane locating flanges.

15. Framework structure as claimed in claim 12, which includes sealing elements that can provide for the sealing location of glass panes within the framework structure.

16. A framework structure as claimed in claim 1, in which the primary framework elements are secured to one another by screws.

17. A framework structure as claimed in claim 1, in which the overall configuration of the framework elements is such that consistent front and rear faces are defined by the assembled framework structure.

18. A framework structure as claimed in claim 1, in which the framework elements are of aluminium.

19. A framework structure as claimed in claim 1, which includes glass panes located in the spaces defined between the framework elements.

20. A rectangular framework structure for a door or window, comprising:

four primary framework elements for forming the outer perimeter of the rectangular framework structure, each said primary framework element having a front wall, a rear wall and a side wall, and a rearwardly directed locating flange extending from near the front wall and having an angle of between about 30° to about 60° to the plane defined by the side wall, and being provided with regularly spaced cutaways;

a plurality of secondary framework elements for extending between a first set of two opposing primary framework elements, each said secondary framework element having a front wall, a rear wall and two side walls, and a rearwardly directed locating flange extending from near the front wall and having an angle of between about 30° to about 60° to the plane defined by the side wall adjacent said flange, and being provided with regularly spaced cutaways;

a plurality of auxiliary framework elements for locating perpendicularly to and between the secondary elements for spacing apart these elements, each said auxiliary framework element having a front wall, a rear wall and two side walls, and a rearwardly directed locating flange extending from near the front wall and having an angle of between about 30° to about 60° to the plane defined by the side wall adjacent said flange, the ends of said auxiliary framework elements being adapted to frictionally fit into said cutaways of said secondary and primary framework elements; and a plurality of tie-rods for extending through said auxiliary framework elements and into apertures in said second set of primary framework elements;

fastening means for securing to the ends of said tie rods to hold together the framework elements, bracing them into a rigid substantially planar structure.

21. A rectangular framework structure for a door or window in accordance with claim 20 wherein said angle of said locating flanges of said primary, secondary and auxiliary framework elements to the planes of said side walls adjacent said flanges is about 45°.

22. A rectangular framework structure for a door or window in accordance with claim 20 further comprising fixed glass plane locating flanges provided in said secondary framework elements which extend generally from and generally parallel to the rear wall of said framework elements.

23. A rectangular framework structure for a door or window in accordance with claim 22 further comprising removable glass plane locating flanges adapted to engage the sidewalls of said auxiliary framework elements which extend generally from and generally parallel to the rear wall of said framework elements.

24. A rectangular framework structure for a door or window in accordance with claim 22 wherein said angled locating flanges define a hollow space adapted to receive sealing elements, and wherein said glass pane locating flanges include a lip extending towards said angular locating flanges to define a space for receiving sealing elements.

25. A rectangular framework structure for a door or window in accordance with claim 24 further comprising sealing elements for locating in said spaces and adapted for sealing of glass panes into said framework structure.

* * * * *